US011473369B2

(12) United States Patent
Chen

(10) Patent No.: US 11,473,369 B2
(45) Date of Patent: Oct. 18, 2022

(54) TOP-DOWN BOTTOM-UP WINDOW COVERING

(71) Applicant: Nien Made Enterprise Co., Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 19 days.

(21) Appl. No.: 17/109,074

(22) Filed: Dec. 1, 2020

(65) Prior Publication Data

US 2022/0170319 A1 Jun. 2, 2022

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/2625* (2013.01); *E06B 2009/3225* (2013.01)

(58) Field of Classification Search
CPC .. E06B 9/322; E06B 9/262; E06B 2009/2625; E06B 2009/3225; E06B 2009/3222; E06B 9/32; E06B 9/326; E06B 2009/2627
See application file for complete search history.

(56) References Cited

U.S. PATENT DOCUMENTS 4,202,395 A 5/1980 Heck
6,328,090 B1 * 12/2001 Anderson ..... E06B 9/264 160/84.05
8,931,540 B2 * 1/2015 Filko ..... E06B 9/68 160/84.06
9,314,125 B2 * 4/2016 Anthony ..... E06B 9/322
9,988,838 B2 * 6/2018 Chen ..... E06B 9/323
10,711,517 B2 * 7/2020 Chen ..... E06B 9/322
2004/0177933 A1 9/2004 Hillman
2006/0196612 A1 * 9/2006 Strand ..... E06B 9/32 160/84.05
2007/0284060 A1 * 12/2007 Liang ..... E06B 9/32 160/170
2008/0093033 A1 4/2008 Hsu
2008/0121350 A1 5/2008 Cheng
(Continued)

FOREIGN PATENT DOCUMENTS

AU 2016222352 A1 3/2017
EP 3 029 258 A1 6/2016
(Continued)

*Primary Examiner* — Johnnie A. Shablack
(74) *Attorney, Agent, or Firm* — Winston Hsu

(57) ABSTRACT

A top-down bottom-up window covering includes a first beam and a second beam, which are sequentially provided below a fixture, and a covering material connecting the first beam and the second beam. A first lifting structure is installed in the first beam, and a second lifting structure is installed in the second beam. The first lifting structure is adapted to operate as the first beam is being controlled to move toward or away from the fixture, and the second lifting structure is adapted to operate as the second beam is being controlled to move toward or away from the fixture. Thus, the top-down bottom-up window covering can be easily assembled and maintained.

10 Claims, 9 Drawing Sheets

(56) References Cited

U.S. PATENT DOCUMENTS

| | | | | |
|---|---|---|---|---|
| 2008/0277076 | A1* | 11/2008 | Cheng | E06B 9/322 160/167 R |
| 2013/0299103 | A1* | 11/2013 | Anderson | E06B 9/322 160/331 |
| 2014/0069592 | A1* | 3/2014 | Hsu | E06B 9/38 160/368.1 |
| 2014/0158314 | A1 | 6/2014 | Anderson | |
| 2015/0211294 | A1* | 7/2015 | Shih | E06B 9/322 160/168.1 R |
| 2016/0208549 | A1 | 7/2016 | Chen | |
| 2017/0067287 | A1 | 3/2017 | Chen | |
| 2018/0313144 | A1 | 11/2018 | Anderson | |
| 2020/0131847 | A1* | 4/2020 | Clark | E06B 9/262 |

FOREIGN PATENT DOCUMENTS

| | | | |
|---|---|---|---|
| JP | 3201418 | U | 12/2015 |
| JP | 3207187 | U | 10/2016 |

* cited by examiner

TOP-DOWN BOTTOM-UP WINDOW COVERING

BACKGROUND OF THE DISCLOSURE

1. Field of the Disclosure

The present invention relates generally to a window covering structure, and more particularly to a top-down bottom-up window covering, of which the covered area can be changed.

2. Description of the Prior Art

A conventional top-down bottom-up window covering has three rails, including a headrail, a middle rail, and a bottom rail. Between the middle rail and the bottom rail, a covering material is provided with two ends thereof respectively connected to the middle rail and the bottom rail. The middle rail is able to move toward or away from the top rail through the driving of two cords; similarly, the bottom rail is able to move toward or away from the top rail, but it is through the driving of two cords other than the two cords connected to the middle rail. With such design, a covered area of a top-down bottom-up window covering can be changed at will, and, of course, so can the area allowing light to pass through.

However, though a conventional top-down bottom-up window covering is flexible in blocking light, there are two sets of reeling units provided in a headrail for reeling in the cords. The space in a headrail is quite limited, and therefore the two sets of reeling units are not only difficult to install, but also tend to interfere with each other. In addition, it is inconvenient to check and repair reeling units accommodated in a headrail.

SUMMARY OF THE DISCLOSURE

In light of the above reasons, one aspect of the present invention is to provide a top-down bottom-up window covering, which is convenient to install or maintain, and also provides an effect of smooth and effortless operation.

The present invention provides a top-down bottom-up window covering, which is adapted to be installed at a fixture. The top-down bottom-up window covering includes a first beam, a second beam, a covering material, a first lifting structure, and a second lifting structure. The first beam is adapted to be located below the fixture when the top-down bottom-up window covering is installed at the fixture. The second beam is located below the first beam. The covering material has an end connected to the first beam, and another end connected to the second beam. The first lifting structure is provided in the first beam, and includes at least a first pulling cord and a first movable member. The first pulling cord is adapted to be fixedly connected to the fixture with an end thereof when the top-down bottom-up window covering is installed at the fixture. The first pulling cord goes into the first beam and gets linked to the first movable member in a manner that the first pulling cord and the first movable member are adapted to be moved concurrently by each other. When the top-down bottom-up window covering is installed at the fixture and when the first beam moves toward or away from the fixture, the first movable member is correspondingly moved in the first beam. The second lifting structure is provided in the second beam, and includes at least a second pulling cord and a second movable member. When the top-down bottom-up window covering is installed at the fixture, the second pulling cord is adapted to be fixedly connected to the fixture with an end thereof. The second pulling cord passes through the first beam, goes into the second beam, and gets linked to the second movable member in a manner that the second pulling cord and the second movable member are adapted to be moved concurrently by each other. When the top-down bottom-up window covering is installed at the fixture and when the second beam is moved toward or away from the fixture, the second movable member is correspondingly moved in the second beam. The second pulling cord directly passes through the first beam without making any turns.

By respectively providing the first lifting structure and the second lifting structure at the first beam and the second beam which control the lifting and lowering, the top-down bottom-up window covering of the present invention would have an effect of convenient assembling and maintenance, and would also have the advantage of labor-saving operation. In addition, the second pulling cord which directly passes through the first beam without making any turns would benefit the first beam that the first beam could be raised and lowered more effortlessly.

These and other objectives of the present disclosure will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
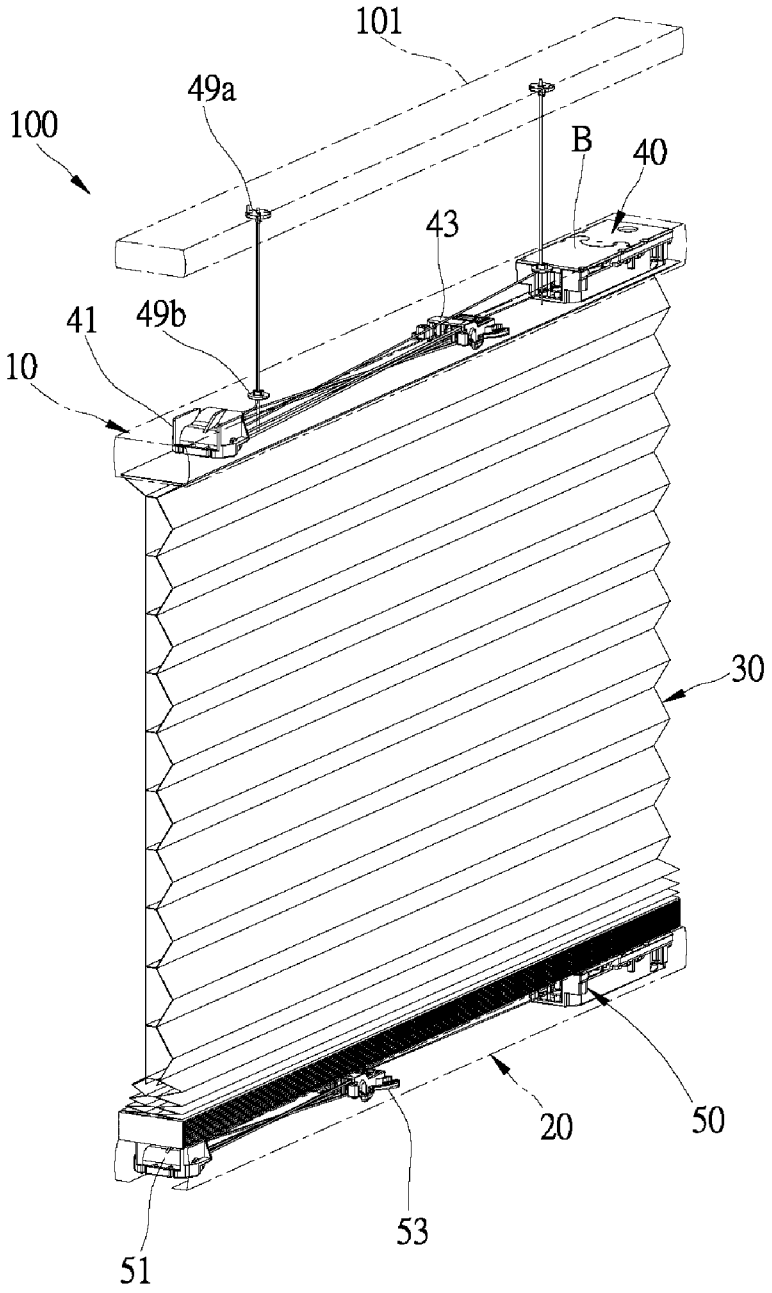
FIG. 1 is a perspective view of a top-down bottom-up window covering of an embodiment of the present invention.
Figure 2:
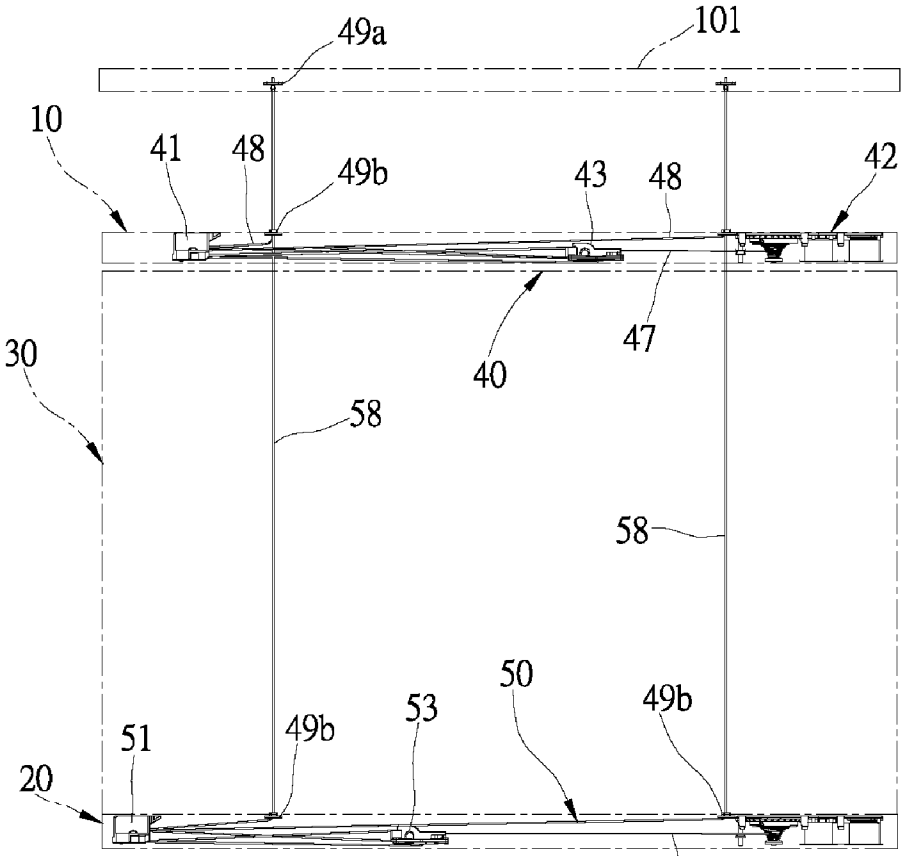
FIG. 2 is a front view of FIG. 1.

As shown in FIG. 1 and FIG. 2, a top-down bottom-up window covering 100 of the present invention is installed onto a fixture to cover a building opening (e.g., a window). The top-down bottom-up window covering 100 includes a first beam 10, a second beam 20, a covering material 30, a first lifting structure 40, and a second lifting structure 50. The first beam 10 is located below an upper beam 101, and the second beam 20 is located below the first beam 10. An end of the covering material 30 is connected to a bottom edge of the first beam 10, and another end thereof is connected to a top edge of the second beam 20. The first lifting structure 40 is provided in the first beam 10 to be operated as the first beam 10 is being moved toward or away from the upper beam 101. The second lifting structure 50 is provided in the second beam 20 to be operated as the second beam 20 is being moved toward or away from the first beam 10. The covering material 30 mentioned above has an excellent light-blocking effect, and its type can be arranged in various ways to meet different use or design requirements, making up all kinds of window covering systems such as window blinds, cellular shades, roman shades, roller shades, etc. In the current embodiment, it is a cellular shade taken as an example. Understandably, an additional covering material can be further provided between the first beam 10 and the upper beam 101 as required, which could further increase the variability of the top-down bottom-up window covering 100 in blocking light. In addition, the fixture mentioned above is a window frame, a beam, or other structures having the effect of securing things. In the current embodiment, the fixture is the upper beam 101 fixed at an upper edge of the building opening. In other words, the upper beam 101 is a part of the window covering, and is sold in sets with other components.

Figure 3:
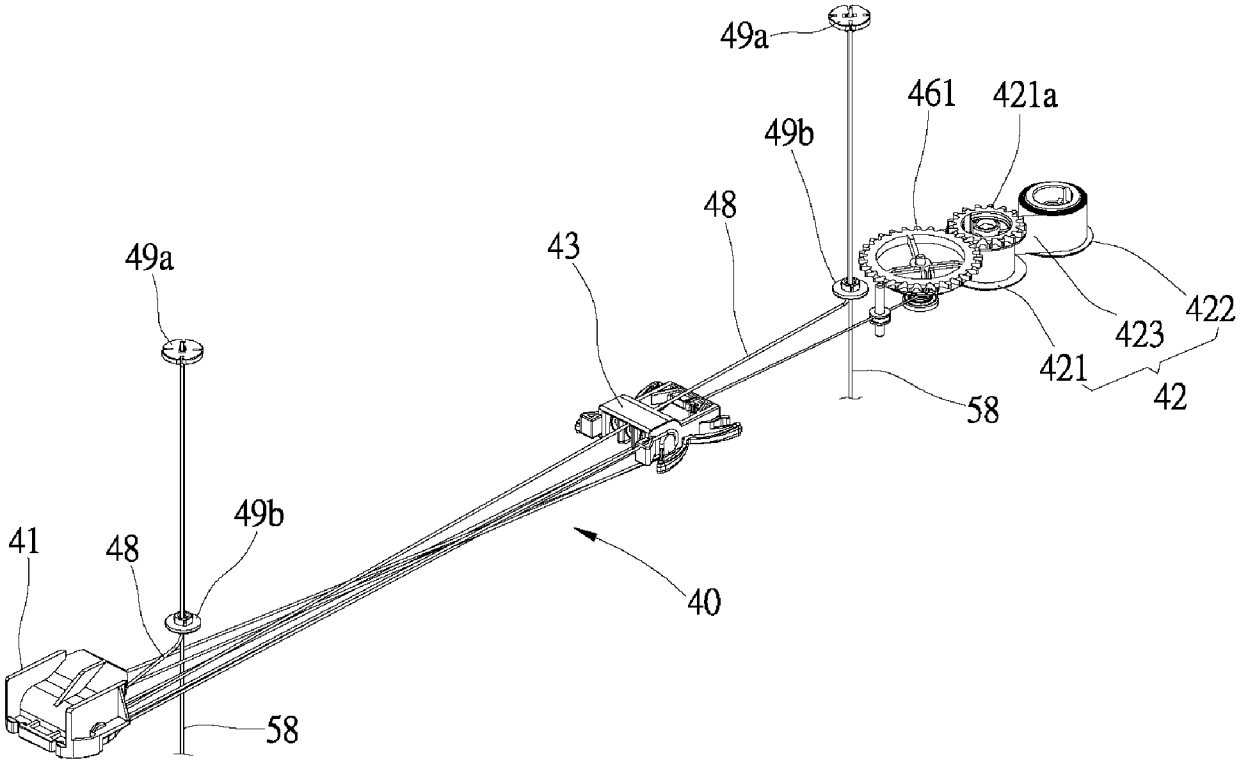
FIG. 3 and FIG. 4 are perspective views of the first lifting structure of the top-down bottom-up window covering of the above embodiment.
Figure 4:
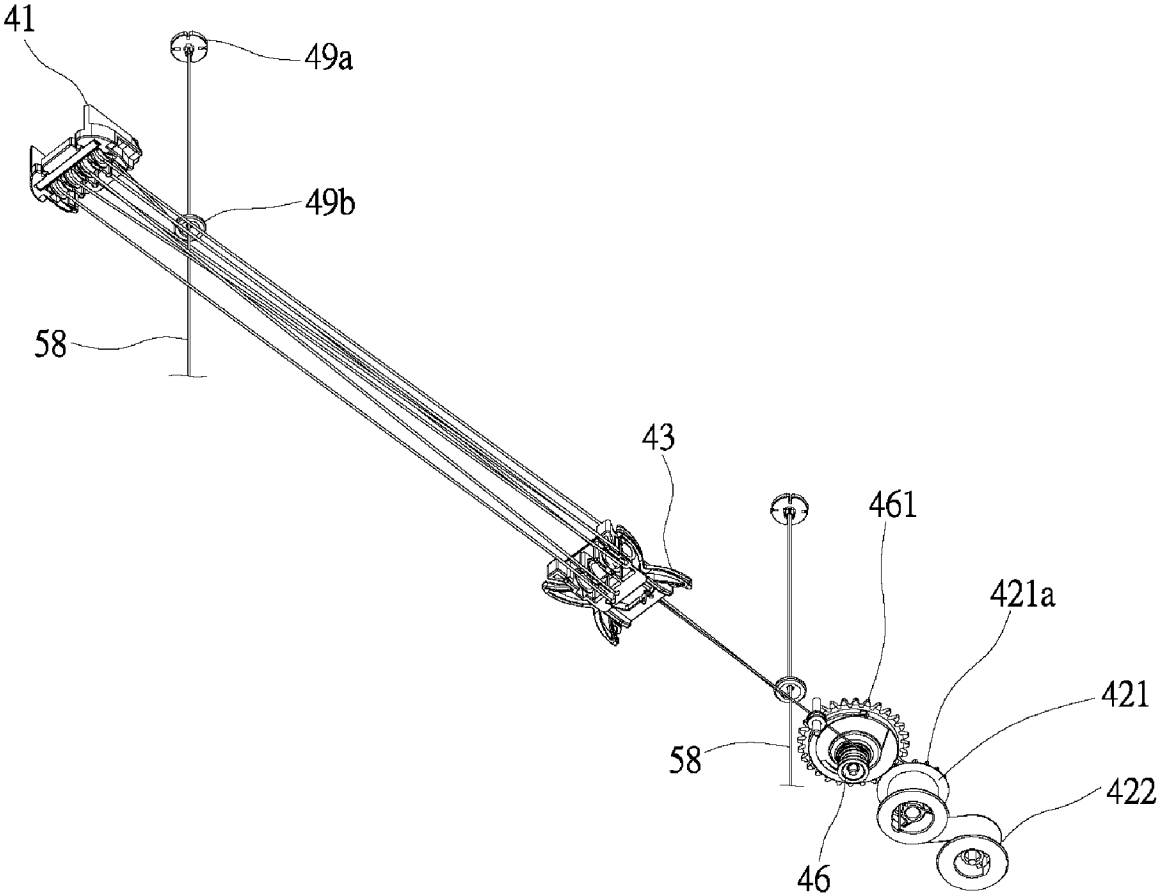
Figure 5:
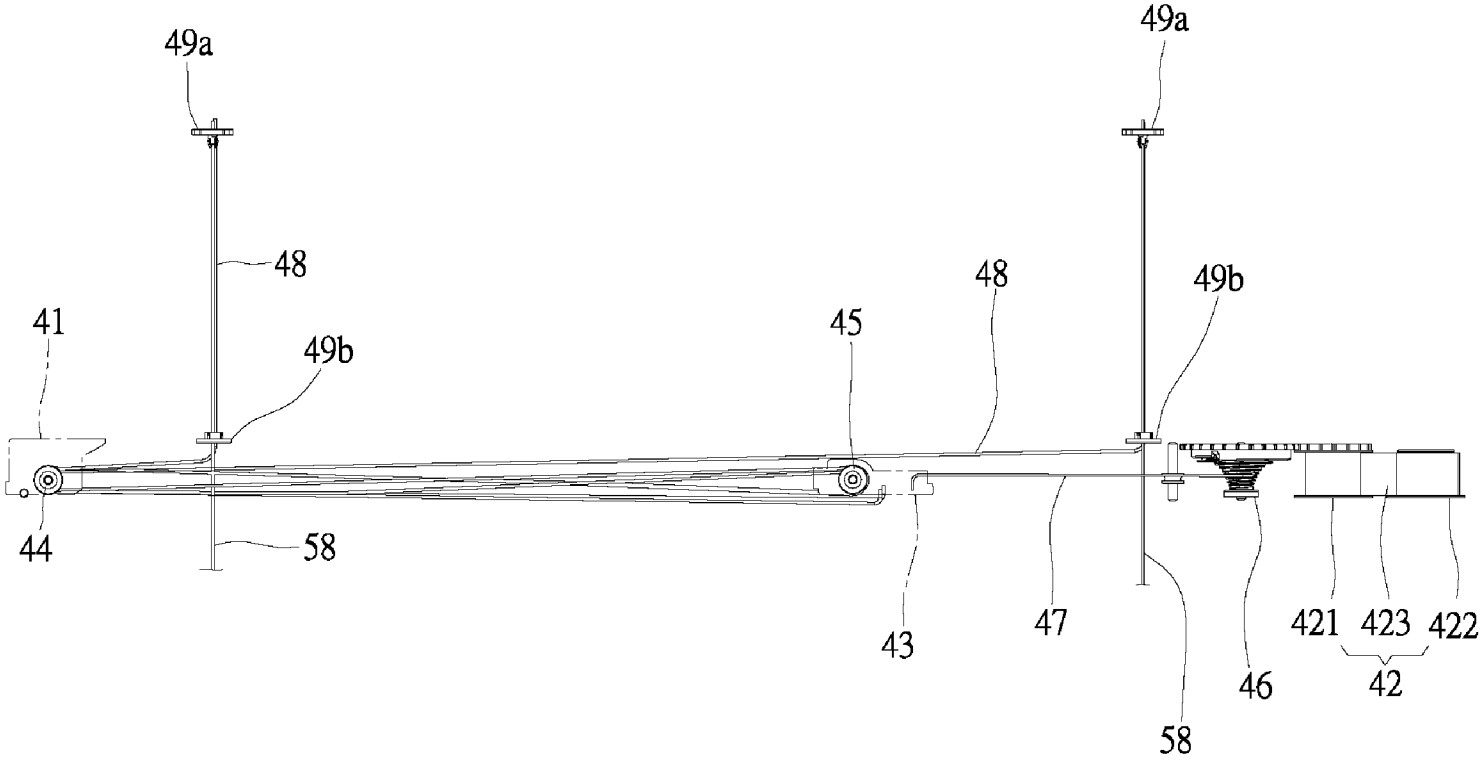
FIG. 5 is a front view of FIG. 3.

Since the first lifting structure 40 and the second lifting structure 50 have identical structures, we take the first lifting structure 40 as an example for illustration. As shown in FIG. 3 to FIG. 5, the first lifting structure 40 includes a first fixed member 41, a first pre-force structure 42, a first movable member 43, a first direction-changing member 44, a first cord-dividing pulley 45, a first cord reel 46, a first connecting cord 47, and a first pulling cord 48. The first fixed member 41 and the first pre-force structure 42 are respectively provided on two opposite sides inside the first beam 10. The first movable member 43 is located between the first fixed member 41 and the first pre-force structure 42, and is movable in the first beam 10. The first direction-changing member 44 is installed at the first fixed member 41, and the first cord-dividing pulley 45 is installed at the first movable member 43. Furthermore, the first direction-changing member 44 and the first cord-dividing pulley 45 both have multiple separated grooves. Preferably, the first direction-changing member 44 and the first cord-dividing pulley 45 are installed in a rotatable manner. The first cord reel 46 is provided on the side of the first pre-force structure 42 in a manner that it can be rotated in situ. Two ends of the first connecting cord 47 are fixedly connected to the first movable member 43 and the first cord reel 46, respectively.

The first pre-force structure 42 mentioned above includes a spring-winding wheel 421, a spring-holding wheel 422, and a coil spring 423, wherein the spring-winding wheel 421 and the spring-holding wheel 422 are both rotatable in situ, and are adjacent to each other. The coil spring 423 winds around the spring-winding wheel 421 and the spring-holding wheel 422 in an S shape, with two ends thereof fixedly connected to the spring-winding wheel 421 and the spring-holding wheel 422, respectively. The numbers of rounds that the coil spring 423 winds around the spring-winding wheel 421 and the spring-holding wheel 422 change along with the change of the rotation direction of the spring-winding wheel 421 and the spring-holding wheel 422. The first cord reel 46 mentioned above is located on a side of the spring-winding wheel 421, with an end thereof connected to a first driving gear 461. The first driving gear 461 meshes with a first driven gear 421*a* which is connected to an end of the spring-winding wheel 421, so that the first cord reel 46 and the spring-winding wheel 421 are linked to be movable by each other. Furthermore, the first cord reel 46 is a conical reel with a helix cord groove recessed on a surface thereof. The first cord reel 46 is provided in the first beam 10 in an upright and rotatable manner, which means the first cord reel 46 has a wide upper end and a narrow lower end, or the other way around. As shown in FIG. 5, the first cord reel 46 in the current embodiment is arranged in a manner that the wider end is on the top side and the narrow end is on the bottom side. The outline of the conical body of the first cord reel 46 renders curved inward; however, the conical body can also be a gradually narrowing funnel shape. It also has to be clarified that, the spring-winding wheel 421, the spring-holding wheel 422, and the coil spring 423 of the first pre-force structure 42 mentioned above are put in a box B (see FIG. 1) with the first cord reel 46 in advance as a modularized structure, which could provide the effect of easy and quick installation.

In the current embodiment, the number of the first pulling cords 48 is two, each of which goes into the upper beam 101 with an end thereof fixedly connected to an adjusting piece 49*a*, whereby the end of each of the first pulling cords 48 is secured at the upper beam 101. Each of the first pulling cords 48 goes into the first beam 10 after passing through a cord-guiding seat 49*b* fixed on a top surface of the first beam 10, and goes around the corresponding first direction-changing member 44, wherein another end of each of the first pulling cords 48 is connected to the corresponding first movable member 43. It needs to be explained that, each of the first pulling cords 48 mentioned above could be directly connected to the first movable member 43 with the another end thereof, without passing by any other components in the first beam 10; alternatively, each of the first pulling cords 48 could, if required, go around the first cord-dividing pulley 45 and the first direction-changing member 44 for even more than once before getting connected to the first movable member 43 or the first fixed member 41 with the another end thereof. For each of the first pulling cords 48, the number of turns it takes between the first cord-dividing pulley 45 and the first direction-changing member 44 is related to the multiples of a lateral moving distance of the first movable member 43 and a vertical moving distance of the first beam 10. Specifically, if one of the first pulling cords 48 sequentially goes around the first direction-changing member 44, the first cord-dividing pulley 45, the first direction-changing member 44 again, and then gets connected to the first movable member 43, it means the running of this first pulling cord 48 includes making three turns. In such a condition, every time the first movable member 43 moves a certain distance, the first beam 10 would be moved by three times the distance. The first pulling cord 48 mentioned herein optionally runs through different grooves each time it goes around the first cord-dividing pulley 45 and the first direction-changing member 44, whereby to make sure that the segments of this pulling cord do not get tangled with one another.

Figure 6:
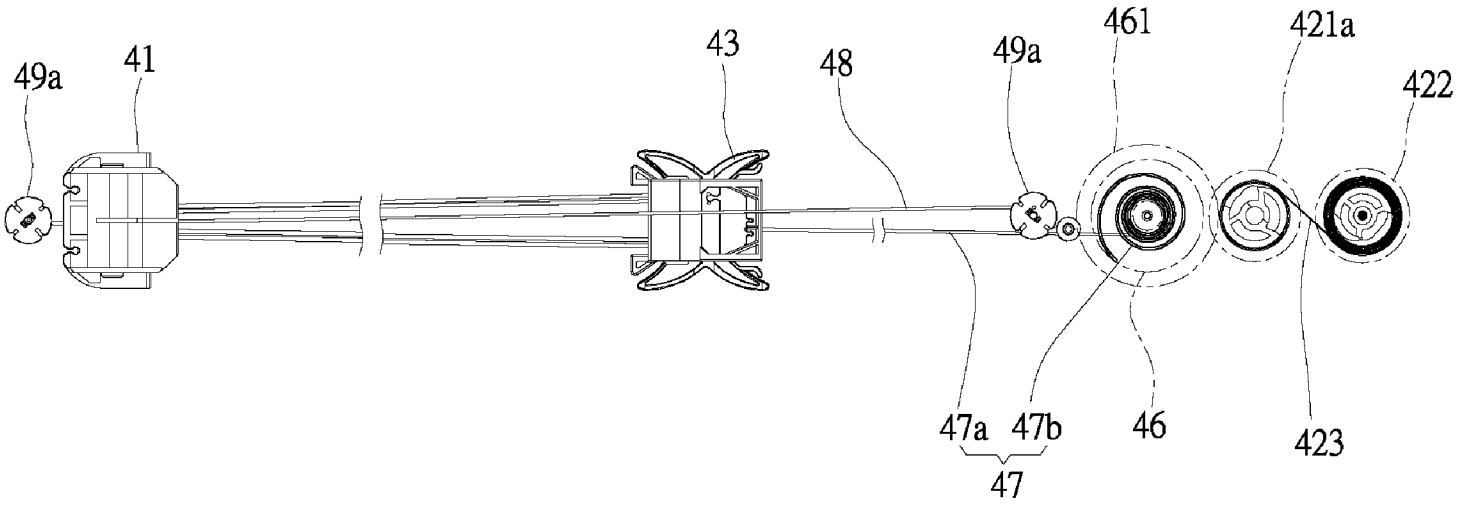
FIG. 6 is a top view of FIG. 5.

FIG. 6 shows the condition of the components of the first lifting structure 40 when the first beam 10 approaches the upper beam 101. At this time, the coil spring 423 of the first pre-force structure 42 has more rounds winding around the spring-holding wheel 422 than around the spring-winding wheel 421, accumulating the pulling force. Such condition urges the first cord reel 46 to keep the tendency of counter-clockwise rotation. Through the first connecting cord 47, the first cord reel 46 which tends to rotate in this rotation direction would have a pulling force on the first movable member 43, which could further ensure the first beam 10 to stay at where it is precisely. Meanwhile, most of the first connecting cord 47 is wound around the first cord reel 46, and therefore, the first connecting cord 47 can be defined to be divided into an exposed segment 47*a* and a winding segment 47*b*, wherein an end of the exposed segment 47*a* is connected to the first movable member 43, and another end of the exposed segment 47*a* is connected to the winding segment 47*b*. The winding segment 47*b* is sequentially received in the cord groove of the first cord reel 46 from top down, whereby to provide different restoring forces as the first beam 10 is located at different locations. Since the bottom of the reversed cone-shaped first cord reel 46 has a narrower diameter, the exposed segment 47*a* of the first connecting cord 47 leaves the first cord reel 46 at a position closer to the central axis of the first cord reel 46, as shown in FIG. 6.

Figure 7:
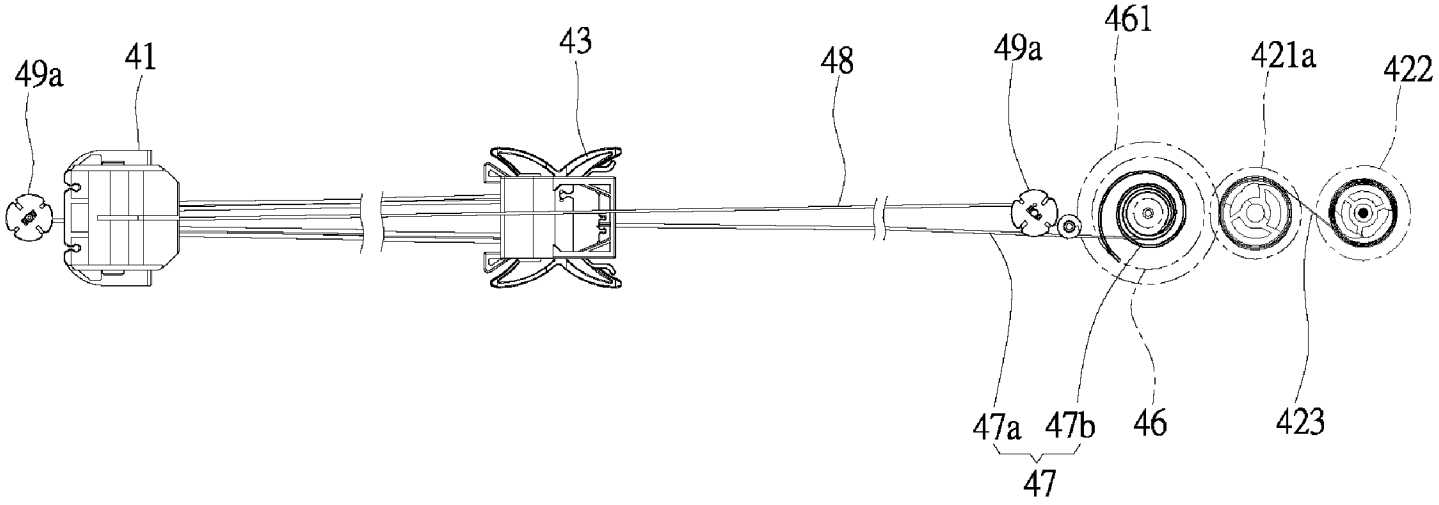
FIG. 7 is similar to FIG. 6, showing that the first movable member of the first lifting structure moves to the left.
Figure 8:
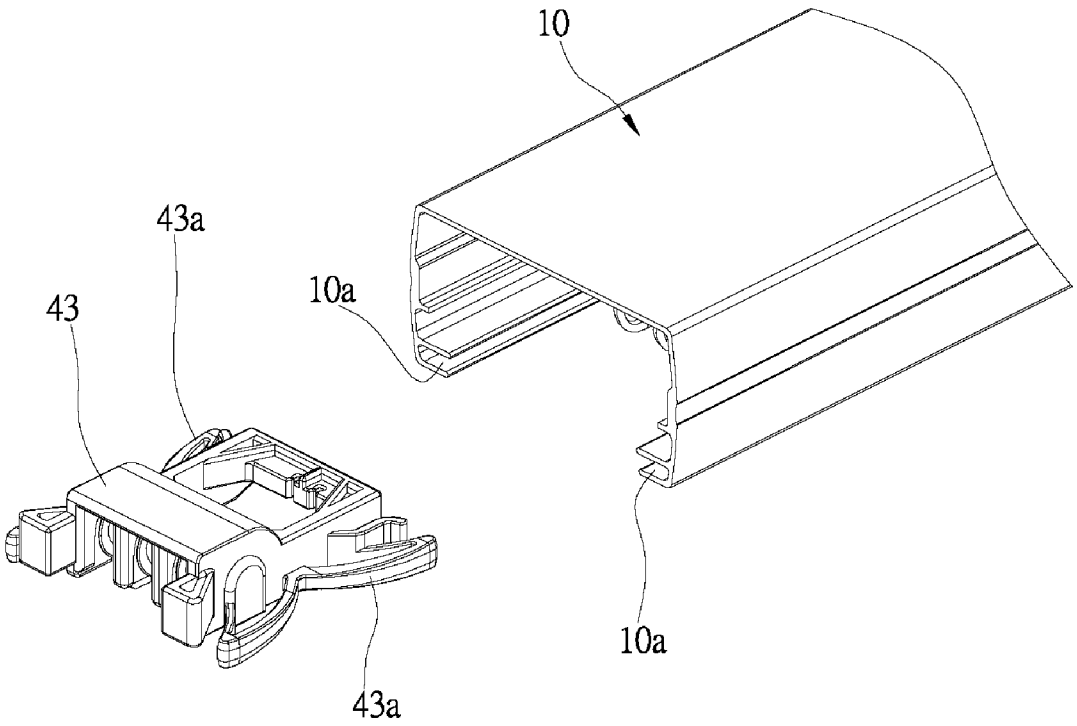
FIG. 8 is a perspective view of part of the components of the top-down bottom-up window covering of the above embodiment.

Since the total length of each of the first pulling cords 48 does not change, a length of the segment of each of the first pulling cords 48 exposed between the first beam 10 and the upper beam 101 increases when the first beam 10 is being pulled down to move the first beam 10 relatively away from the upper beam 101. In such a condition, the first movable member 43 would be drawn by the first pulling cords 48 to move toward the first fixed member 41, as shown in FIG. 7. The moving first movable member 43 will pull the first connecting cord 47, whereby the winding segment 47*b* wound around the first cord reel 46 will be gradually released from the first cord reel 46 in an order from bottom up to reduce a length of the winding segment 47*b*. On the contrary, a length of the exposed segment 47*a* of the first connecting cord 47 will gradually increase, and the exposed segment 47*a* of the first connecting cord 47 will leave the first cord reel 46 at a position farther away from the central axis of the first cord reel 46. As a result, the first cord reel 46 is driven to rotate clockwise, which urges the rotation directions of the spring-winding wheel 421 and the spring-holding wheel 422 to change. Consequently, most of the coil spring 423 will be wound around the spring-winding wheel 421 instead. The specific implementation in the current embodiment is to have more rounds of the coil spring 423 wound around the spring-winding wheel 421 than around the spring-holding wheel 422. After that, if the first beam 10 is operated to move upward again, the coil spring 423 can provide a rewinding force to help to save the effort required for moving the first beam 10 to approach the upper beam 101. Furthermore, as shown in FIG. 8, the first movable member 43 in the current embodiment is made of light-weight plastic, and has flexible wings 43*a* integrally formed on both sides. The flexible wings 43*a* are formed by ribs bulging outward. The first beam 10 has guiding slots 10*a* provided in a longitudinal direction on inner walls thereof. By placing the flexible wings 43*a* in the guiding slots 10*a*, the first movable member 43 can have its location restricted, and can be moved smoothly in a sliding manner.

As shown in FIG. 2, the second lifting structure 50 is provided in the second beam 20, and the constituent components and the positional relationship between them are all the same as those of the first lifting structure 40, including: a second fixed member 51 the same as the above-mentioned first fixed member 41, a second pre-force structure 52 the same as the above-mentioned first pre-force structure 42, a second movable member 53 the same as the above-mentioned first movable member 43, a second direction-changing member (not shown) the same as the above-mentioned first direction-changing member 44, a second cord-dividing pulley (not shown) the same as the above-mentioned first cord-dividing pulley 45, a second cord reel 56 the same of the above-mentioned first cord reel 46, a second connecting cord 57 the same as the above-mentioned first connecting cord 47, and two second pulling cords 58 the same as the above-mentioned first pulling cords 48.

Like each of the first pulling cords 48, each of the second pulling cords 58 of the second lifting structure 50 also has an end fixedly connected to the adjusting piece 49*a* on the upper beam 101. Each of the second pulling cords 58 sequentially passes through the cord-guiding seat 49*b* on the first beam 10, the first beam 10 itself, the covering material 30, another cord-guiding seat 49*b* fixed on a top surface of the second beam 20, and then goes around the second direction-changing member and the second cord-dividing pulley, with another end thereof connected to the second movable member 53. The principles and effects of the motion made by the second lifting structure 50 are the same as the first lifting structure 40, and therefore we are not going to describe the details herein. However, it is worth mentioning that each of the second pulling cords 58 directly passes through the first beam 10 without making any turns, and does not have any correlation or linking relationship with any components of the first lifting structure 40. Therefore, when the first beam 10 is being pushed or pulled, there would not be any friction issue since the second pulling cords 58 and the first lifting structure 40 have no contact therebetween. In this way, the first beam 10 could be moved up and down effortlessly.

The top-down bottom-up window covering 100 of the current embodiment has the effect of adjusting the shaded areas (or, in another way of saying, the areas allowing light to pass through) in the upper and lower portions. Furthermore, the first lifting structure 40 and the second lifting structure 50 are respectively installed in the first beam 10 and the second beam 20 that are able to control the lifting and lowering, and therefore would be convenient to assembly or maintain. In addition, since the second pulling cord 58 of the second lifting structure 50 directly passes through the first beam 10 without making any turns, there would be no unwanted friction created while pulling or pushing the first beam 10. As a result, the first beam 10 could be raised and lowered more effortlessly.

Figure 9:
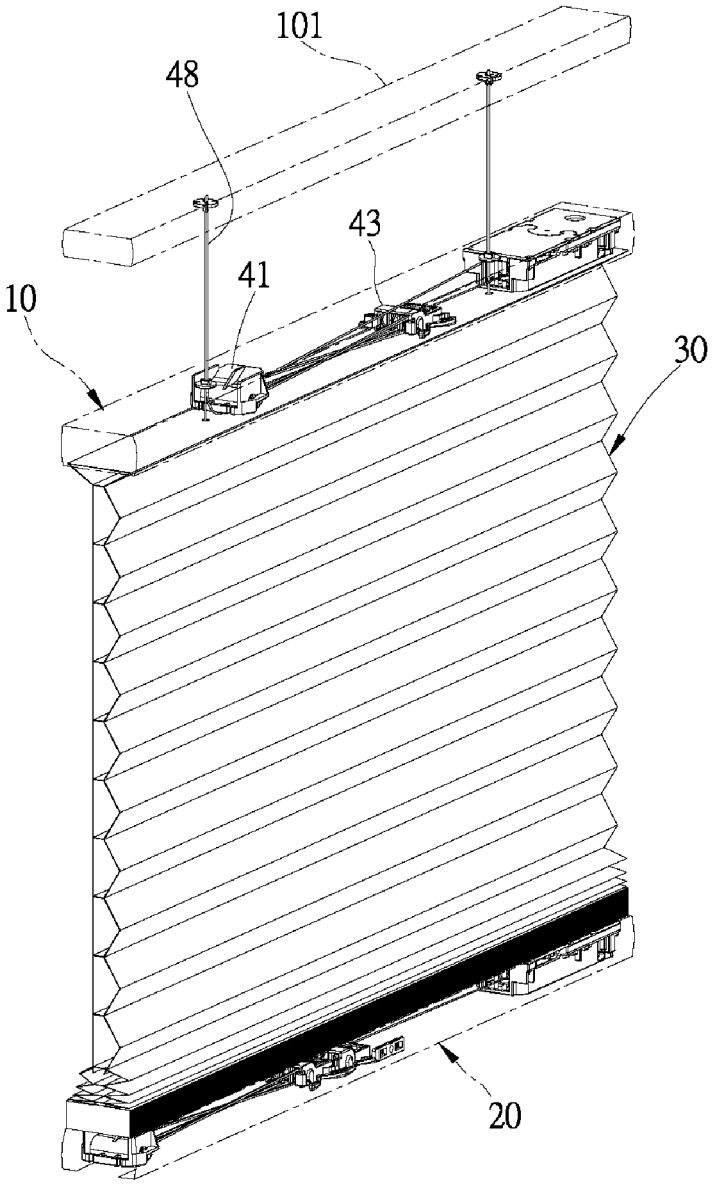
FIG. 9 is a perspective view of a top-down bottom-up window covering of another embodiment of the present invention.

Please see FIG. 2, the first fixed member 41 of the first lifting structure 40 is provided on an outer side of the first pulling cord 48 on the left side. To avoid the first movable member 43 from accidentally touching the first pulling cord 48 while moving left, a total length of the first pulling cord 48 and the turns its running makes as going around the first direction-changing member 44 and the first cord-dividing pulley 45 are both designed with practical demands taken into consideration, so that the first movable member 43 are not allowed to move to any position exceeding the right side (i.e., the inner side) of the first pulling cord 48 on the left side. Of course, the first fixed member 41 can also be installed on the inner side of the first pulling cord 48 on the left side, as shown in FIG. 9, i.e., between the two first pulling cords 48 but close to the first pulling cord 48 on the left side. In this way, the first movable member 43 could be ensured that it would not contact the first pulling cord 48 on the left side as being moved. With the arrangements mentioned above, it would be convenient to assemble, check, and maintain the first lifting structure 40 and the second lifting structure 50 installed in the first beam 10 and the second beam 20. Furthermore, the first beam 10 could be effortlessly operated.

It must be pointed out again that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A top-down bottom-up window covering, which is adapted to be installed at a fixture; the top-down bottom-up window covering comprising:

a first beam, which is adapted to be located below the fixture when the top-down bottom-up window covering is installed at the fixture;

a second beam located below the first beam;

a covering material, of which an end is connected to the first beam, and another end is connected to the second beam;

a first lifting structure, which is provided in the first beam, wherein the first lifting structure comprises at least a first pulling cord and a first movable member; the first pulling cord is adapted to be fixedly connected to the fixture with an end thereof when the top-down bottom-up window covering is installed at the fixture; the first pulling cord goes into the first beam and gets linked to the first movable member in a manner that the first pulling cord and the first movable member are adapted to be moved concurrently by each other; and a second lifting structure, which is provided in the second beam, wherein the second lifting structure comprises at least two second pulling cords and a second movable member; when the top-down bottom-up window covering is installed at the fixture, each of the second pulling cords is adapted to be fixedly connected to the fixture with an end thereof; each of the second pulling cords directly passes through the first beam without making any turns, goes into the second beam, and gets linked to the second movable member in a manner that the second pulling cords and the second movable member are adapted to be moved concurrently by each other; when the top-down bottom-up window covering is installed at the fixture and when the second beam is moved toward or away from the fixture, the second movable member is correspondingly moved in the second beam;

wherein when the top-down bottom-up window covering is installed at the fixture and when the first beam moves toward or away from the fixture, the first movable member is correspondingly moved in the first beam with a reciprocating path of the first movable member restricted between the two second pulling cords.

2. The top-down bottom-up window covering of claim 1, wherein at least one of the first movable member and the second movable member has a flexible wing, and at least one of the first beam and the second beam has a guiding slot on an inner wall thereof; the flexible wing is received in the guiding slot.

3. The top-down bottom-up window covering of claim 1, wherein the first lifting structure comprises a first direction-changing member and a first cord-dividing pulley; the first direction-changing member is fixed in the first beam; the first cord-dividing pulley is provided on the first movable member; the first pulling cord goes around the first direction-changing member and the first cord-dividing pulley.

4. The top-down bottom-up window covering of claim 1, wherein the second lifting structure comprises a second direction-changing member and a second cord-dividing pulley; the second direction-changing member is fixed in the second beam; the second cord-dividing pulley is provided on the second movable member; each of the second pulling cords goes around the second direction-changing member and the second cord-dividing pulley.

5. The top-down bottom-up window covering of claim 1, wherein the first lifting structure comprises a first connecting cord, a first cord reel, and a first pre-force structure; two ends of the first connecting cord are fixedly connected to the first cord reel and the first movable member, respectively; the first cord reel is adapted to be rotated to reel in or release the first connecting cord; the first pre-force structure and the first cord reel are provided in a linked manner that the first pre-force structure and the first cord reel are adapted to be moved concurrently by each other; when the top-down bottom-up window covering is installed at the fixture and when the first beam is moved in a direction away from the fixture, the first pulling cord pulls the first movable member, so that the first cord reel is rotated to release the first connecting cord.

6. The top-down bottom-up window covering of claim 5, wherein an end of the first cord reel is connected to a first driving gear; the first pre-force structure comprises a spring-winding wheel, a spring-holding wheel, and a coil spring, wherein an end of the spring-winding wheel is connected to a first driven gear, which meshes with the first driving gear; two ends of the coil spring are respectively connected to the spring-winding wheel and the spring-holding wheel; rounds of the coil spring being wound around the spring-winding wheel and the spring-holding wheel change along with a change in rotation directions of the spring-winding wheel and the spring-holding wheel.

7. The top-down bottom-up window covering of claim 5, wherein the first cord reel is conical, and is provided in the first beam in an upright and rotatable manner.

8. The top-down bottom-up window covering of claim 1, wherein the second lifting structure comprises a second connecting cord, a second cord reel, and a second pre-force structure; two ends of the second connecting cord are fixedly connected to the second cord reel and the second movable member, respectively; the second cord reel is adapted to be rotated to reel in or release the second connecting cord; the second pre-force structure and the second cord reel are provided in a linked manner that the second pre-force structure and the second cord reel are adapted to be moved concurrently by each other; when the second beam is moved in a direction away from the first beam, the second pulling cords pull the second movable member, so that the second cord reel is rotated to release the second connecting cord.

9. The top-down bottom-up window covering of claim 8, wherein an end of the second cord reel is connected to a second driving gear; the second pre-force structure comprises a spring-winding wheel, a spring-holding wheel, and a coil spring, wherein an end of the spring-winding wheel is connected to a second driven gear, which meshed with the second driving gear; two ends of the coil spring are respectively connected to the spring-winding wheel and the spring-holding wheel; rounds of the coil spring wound around the spring-winding wheel and the spring-holding wheel change along with a change in rotation directions of the spring-winding wheel and the spring-holding wheel.

10. The top-down bottom-up window covering of claim 8, wherein the second cord reel is conical, and is provided in the second beam in an upright and rotatable manner.

* * * * *